US009469112B2

(12) United States Patent
Berrios et al.

(10) Patent No.: US 9,469,112 B2
(45) Date of Patent: Oct. 18, 2016

(54) ROTARY WIPER ASSEMBLY FOR FLUID-EJECTION PRINTHEAD

(75) Inventors: Jacinto Berrios, San Diego, CA (US); Matias Negatu, San Diego, CA (US); Rafael Ulacia Portoles, San Diego, CA (US); Michael W. Munro, Escondido, CA (US)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 1305 days.

(21) Appl. No.: 12/400,638

(22) Filed: Mar. 9, 2009

(65) Prior Publication Data

US 2010/0225699 A1 Sep. 9, 2010

(51) Int. Cl.
*B41J 2/165* (2006.01)

(52) U.S. Cl.
CPC ..... *B41J 2/16544* (2013.01); *B41J 2/16552* (2013.01); *B41J 2/16541* (2013.01)

(58) Field of Classification Search
None
See application file for complete search history.

(56) References Cited

U.S. PATENT DOCUMENTS

| | | | | |
|---|---|---|---|---|
| 5,614,930 | A | 3/1997 | Osborne et al. | |
| 5,896,145 | A | 4/1999 | Osborne et al. | |
| 6,375,302 | B1 * | 4/2002 | Medin | 347/28 |
| 6,601,943 | B2 | 8/2003 | Barinaga | |
| 6,913,338 | B2 * | 7/2005 | Rhoads et al. | 347/28 |
| 7,182,428 | B2 | 2/2007 | Le Gallo | |
| 7,472,982 | B2 | 1/2009 | Chen | |
| 2002/0075350 | A1 | 6/2002 | Sawicki | |
| 2002/0126178 | A1 | 9/2002 | Toh et al. | |
| 2002/0140766 | A1 | 10/2002 | Niederhausern et al. | |
| 2004/0174409 | A1 | 9/2004 | Park et al. | |
| 2007/0188545 | A1 | 8/2007 | Miyamoto | |
| 2007/0229588 | A1 | 10/2007 | Furukawa et al. | |
| 2008/0007592 | A1 | 1/2008 | Watanabe | |
| 2008/0012897 | A1 | 1/2008 | Miyazawa | |

FOREIGN PATENT DOCUMENTS

| | | | |
|---|---|---|---|
| EP | 1110736 | A1 | 6/2001 |
| EP | 1310369 | A1 | 5/2003 |

* cited by examiner

*Primary Examiner* — Alejandro Valencia
(74) *Attorney, Agent, or Firm* — Michael A. Dryja

(57) ABSTRACT

A rotary wiper assembly for a fluid-ejection printhead that has fluid-ejection nozzles includes one or more wipers and a rotatable shaft to which the wipers are at least indirectly attached. The rotatable shaft is to rotate the wipers to a static wiping position. While the wipers are stationary in the static wiping position, the fluid-ejection printhead is to move back and forth in relation to the wipers while the wipers are not to move, to cause the wipers to come into contact with the fluid-ejection nozzles to wipe material from the fluid-ejection nozzles.

12 Claims, 8 Drawing Sheets

ROTARY WIPER ASSEMBLY FOR FLUID-EJECTION PRINTHEAD

BACKGROUND

Fluid-ejection devices include inkjet-printing devices that are commonly employed to form images on media like paper using ink. A fluid-ejection device typically includes a fluid-ejection printhead that has a number of fluid-ejection nozzles that eject fluid onto media. However, debris, dried fluid, and other types of material can become lodged on the fluid-ejection nozzles. Therefore, a wiping operation may have to be periodically performed to wipe such material from the fluid-ejection nozzles so that they can continue to properly eject fluid.

DETAILED DESCRIPTION

Statement of Problem and Brief Overview of Solution

As noted in the background section, a wiping operation may have to be periodically performed to wipe undesirable material from the fluid-ejection nozzles of a fluid-ejection printhead of a fluid-ejection device like an inkjet-printing device. Such undesirable material can include debris like media dust, fluid that has dried on the fluid-ejection nozzles, as well as other types of undesirable material. Performing the wiping operation desirably wipes or removes such material from the fluid-ejection nozzles so that they can continue to properly eject fluid.

One type of wiping assembly that can be used is a linear wiping assembly. A linear wiping assembly includes one or more wipers that are wiped in a linear motion back and forth against the fluid-ejection nozzles of a fluid-ejection printhead to remove undesirable material from the nozzles. Linear wiping assemblies can be effective. However, due to their linear motion, such linear wiping assemblies can occupy a relatively large amount of space within a fluid-ejection device. This is disadvantageous, because space within a fluid-ejection device is usually at a premium.

To conserve the space that is occupied by a wiping assembly, another type of wiping assembly that has been attempted is a rotary wiping assembly. A rotary wiping assembly includes one or more wipers that are wiped in a rotating motion back and forth against the fluid-ejection nozzles of a fluid-ejection printhead to remove undesirable material from the nozzles. While rotary wiping assemblies can be effective, they have proven to be sufficiently complicated in design and in operation to resist widespread usage in fluid-ejection devices for cost and frequency of repair reasons. Few, if any, commercially available fluid-ejection devices thus employ rotary wiping assemblies.

The inventors have innovatively recognized that an aspect of a rotary wiping assembly that contributes to its complicated design and operation is the fact that while the fluid-ejection printhead remains stationary, the assembly wipers rotate back and forth against the fluid-ejection nozzles of the printhead to wipe the nozzles. Pursuant to this inventive insight, the inventors have invented a rotary wiper assembly that omits this aspect of existing rotary wiping assemblies. In particular, in accordance with at least some embodiments of the present disclosure, during wiping of the fluid-ejection nozzles of a fluid-ejection printhead, the wipers of a rotary wiping assembly remain stationary, while the printhead moves back and forth past the wipers for the wipers to wipe debris from the nozzles.

Stationary Wiping Position of Rotary Wiper Assembly Wipers

Figure 1A:
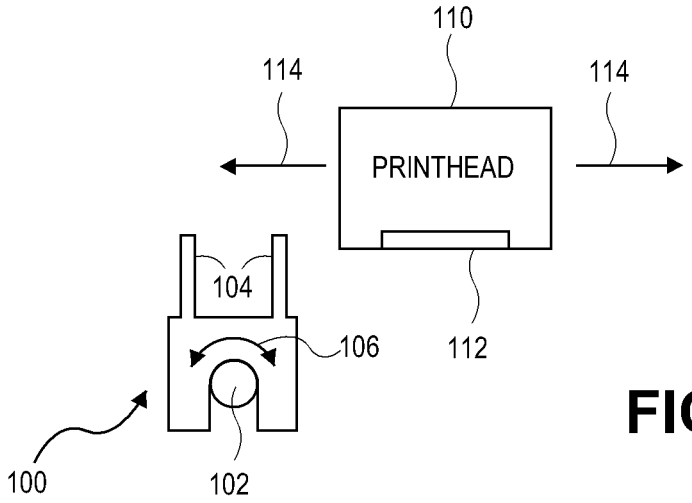
FIG. 1A is a diagram of a static wiping position of wipers of a rotary wiper assembly in which the wipers wipe fluid-ejection nozzles of a fluid-ejection printhead, according to an embodiment of the present disclosure.

FIG. 1A shows a stationary wiping position of one or more wipers 104 of a rotary wiper assembly 100, according to an embodiment of the disclosure. The rotary wiper assembly 100 includes a rotatable shaft 102 and the wipers 104. The wipers 104 are at least indirectly attached to the rotatable shaft 102. A particular embodiment as to how the wipers 104 are attached to the rotatable shaft 102 is presented later in the detailed description. The rotatable shaft 102 is able to rotate, as indicated by arrow 106. When the rotatable shaft 102 rotates, the wipers 104 correspondingly rotate. The rotary wiper assembly 100 is a wiper assembly because it includes the wipers 104, and is a rotary assembly because it has a rotational movement, as indicated by the arrow 106, as opposed to a linear translational movement.

In FIG. 1A, the rotatable shaft 102 has rotated so that the wipers 104 are in a stationary wiping position. In the stationary wiping position, the wipers 104 do not move. Rather, a fluid-ejection printhead 110 having fluid-ejection nozzles 112 disposed on the bottom of the printhead 110 linearly moves back and forth in relation to the wipers 104 in a linear translational movement, as indicated by arrows 114. As such, the fluid-ejection nozzles 112 come into contact with the wipers 104, to wipe undesirable material from the nozzles 112. The fluid-ejection nozzles 112 are represented in FIG. 1A as a single block, but in actuality include a number of orifices, which may be round or rectangular, from which fluid is ejected by the fluid-ejection printhead 110.

An innovative aspect of the stationary wiping position of the wipers 104 in FIG. 1A is thus that the wipers 104 do not move while in the stationary wiping position. Rather, once the rotatable shaft 102 has rotated so that the wipers 104 are in this stationary wiping position, the fluid-ejection printhead 110 itself moves. That is, the wipers 104 wipe the fluid-ejection nozzles 112 of the fluid-ejection printhead 110 by remaining in the stationary wiping position, while the printhead 110 itself moves so that the wipers 104 wipe the nozzles 112 of the printhead 110.

Wiping Liquid Dispensing Position of Rotary Wiper Assembly Wipers

Figure 1B:
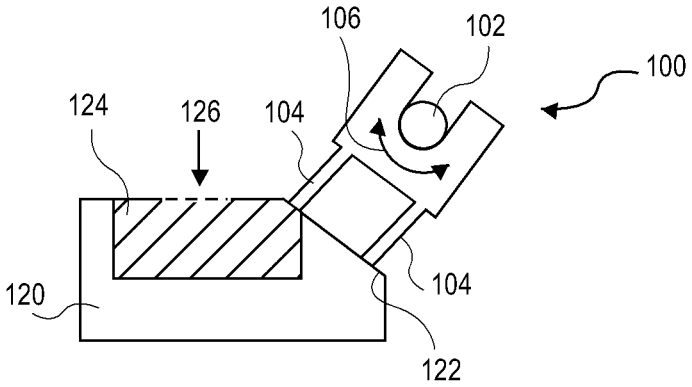
FIG. 1B is a diagram of a wiping liquid dispensing position of wipers of a rotary wiper assembly in which the wipers receive wiping liquid, according to an embodiment of the present disclosure.

FIG. 1B shows a wiping liquid dispense position of the wipers 104 of the rotary wiper assembly 100, according to an embodiment of the disclosure. In FIG. 1B, the rotatable shaft 102 is rotated, as indicated by the arrows 106, so that the wipers 104 are rotated to the wiping liquid dispense position. In the wiping liquid dispense position, a wiping liquid dispense mechanism 120 dispenses wiping liquid onto the wipers 104, such that the wipers 104 receive the wiping liquid as dispensed by the mechanism 120. The wiping liquid may be a lubricant and/or a solvent. One type of wiping liquid is polyethylene glycol (PEG). The wipers 104 may be moved to the wiping liquid dispensing position to receive wiping liquid prior to wiping the fluid-ejection nozzles 112 of the fluid-ejection printhead 110 in the wiping position of FIG. 1A.

The wiping liquid dispense mechanism 120 includes an absorbent material 124 within which the wiping liquid is contained. The wiping liquid dispense mechanism 120 further has a downward-sloped surface 122. The downward-sloped surface 122 is in fluidic contact with the absorbent material 124, in that a slot 126 within the wiping liquid dispense mechanism 120 permits the wiping liquid to travel from the material 124 to the top of the wiping liquid dispense mechanism 120 and down the surface 122. That is, the slot 126 exposes the absorbent material 124, such that it can be said that the downward-sloped surface 122 makes contact with the material 124 via the slot 126. The absorbent material 124 can be a fluid-retaining foam.

Therefore, in the wiping liquid dispensing position, the wipers 104 make contact against the downward-sloped surface 122 of the wiping liquid dispense mechanism 120. By making contact against the downward-sloped surface 122, the wipers 104 receive wiping liquid by interference and capillary action. That is, the wiping liquid travels from the absorbent material 124 to the downward-sloped surface 122 via capillary action (and gravity), and onto the wipers 104 in the wiping liquid dispensing position via capillary action due to physical interference between the wipers 104 and the surface 122. The wipers 104 can remain stationary and may not move while receiving the wiping liquid in the wiping liquid dispensing position.

Scraping Position of Rotary Wiper Assembly Wipers

Figure 1C:
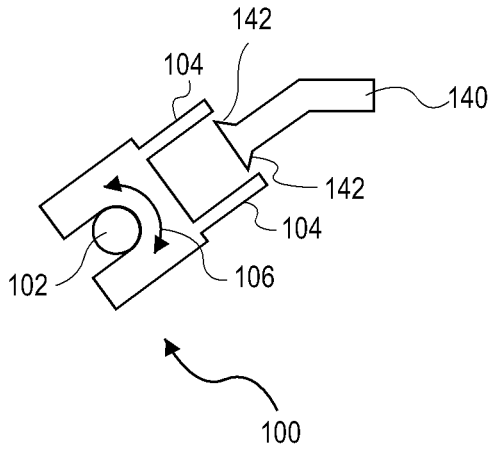
FIG. 1C is a diagram of a scraping position of wipers of a rotary wiper assembly in which the wipers are scraped, according to an embodiment of the present disclosure.

FIG. 1C shows a scraping position of the wipers 104 of the rotary wiper assembly 100, according to an embodiment of the disclosure. In FIG. 1C, the rotatable shaft 102 is rotated back and forth, as indicated by the arrows 106, so that the wipers 104 correspondingly rotate back and forth through the scraping position. In the scraping position, a scrape mechanism 140 scrapes the wipers 104. That is, as the wipers 104 are rotated back and forth through the scraping position, the wiping surfaces of each of the wipers 104 are scraped by the scrape mechanism 140. The wipers 104 may rotate back and forth through the scraping position after the wipers 104 have wiped the fluid-ejection nozzles 112 of the fluid-ejection printhead 110 in the wiping position of FIG. 1A.

The scrape mechanism 140 includes a downward-sloped surface 142 with which the wipers 104 make contact as the wipers 104 are rotated back and forth through the scraping position. As such, the downward-sloped surface 142 scrapes the wiping surfaces of each of the wipers 104. The downward-sloped surface 142 is downward-sloped so that any undesirable material scraped from the wipers 104 is drained away from the wipers 104, such as downwards due to gravity. It is noted that during scraping, the wipers 104 are rotating (i.e., moving).

Home Position of Rotary Wiper Assembly Wipers

Figure 1D:
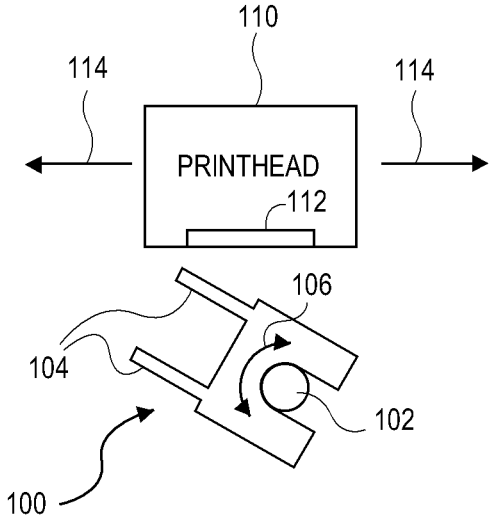
FIG. 1D is a diagram of a home position of wipers of a rotary wiper assembly in which the wipers can remain while a fluid-ejection printhead ejects fluid, according to an embodiment of the present disclosure.

FIG. 1D shows a home position of the wipers 104 of the rotary wiper assembly 100, according to an embodiment of the disclosure. In FIG. 1D, the rotatable shaft 102 is rotated, as indicated by the arrows 106, so that the wipers 104 are rotated to their home position. In the home position, the wipers 104 are not in the wiping position of FIG. 1A, in the liquid dispensing position of FIG. 1B, or in the scraping position of FIG. 1C. The wipers 104 may be moved to the home position, for instance, before or after the wipers 104 have received wiping liquid in the liquid dispensing position of FIG. 1B, have wiped the fluid-ejection nozzles 112 of the fluid-ejection printhead 110 in the wiping position of FIG. 1A, and have been scraped in the scraping position of FIG. 1C.

In the home position, the wipers 104 are in a position in which they cannot contact the fluid-ejection nozzles 112 of the fluid-ejection printhead 110 while, for instance, the printhead 110 ejects fluid via its nozzles 112. As such, while in the home position, the wipers 104 cannot contact the fluid-ejection nozzles 112 of the fluid-ejection printhead 110 when the printhead 110 linearly moves as indicated by the arrows 114. Therefore, in the home position, the wipers 104 remain stationary and do not move.

Fluid-Ejection Printhead Corner Cleaning

Figure 2:
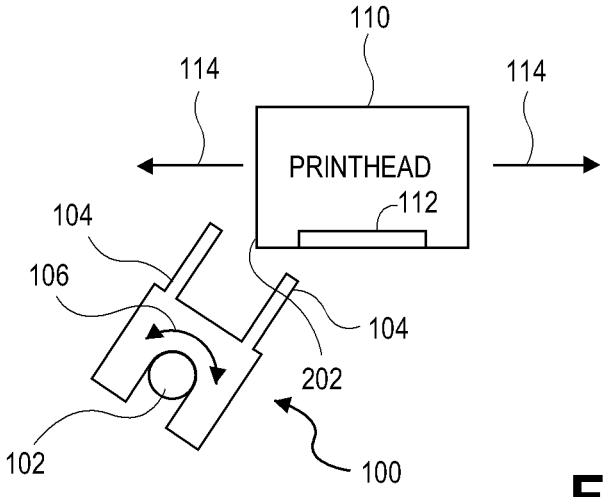
FIG. 2 is a diagram depicting how wipers of a rotary wiper assembly can rotate to clean a corner of a fluid-ejection printhead, according to an embodiment of the present disclosure.

FIG. 2 shows how a representative corner 202 of the fluid-ejection printhead 110 can be cleaned using the rotary wiper assembly 100, according to an embodiment of the disclosure. The inventors have innovatively recognized that the corners of a fluid-ejection printhead, such as the corner 202 of the printhead 110, tend to have undesirable material built up after the fluid-ejection printhead has been used to eject fluid. Therefore, in addition to wiping the fluid-ejection nozzles 112 of the fluid-ejection printhead 110, the inventors have inventively concluded that it is desirable to wipe the corners of the printhead 110, such as the representative corner 202, to remove any undesirable material from the corners of the printhead 110.

In FIG. 2, the fluid-ejection printhead 110 is suitably positioned via linear translation movement, as indicated by the arrows 114, so that back-and-forth rotation of the rotatable shaft 102, as indicated by the arrow 106, results in corresponding back-and-forth rotation of the wipers 104 to wipe material from the corner 202. During corner cleaning, then, the fluid-ejection printhead 110 remains stationary while the wipers 104 rotate, which is in contradistinction to cleaning of the fluid-ejection nozzles 112, in which the wipers 104 remain stationary while the printhead 110 moves. Once the wipers 104 have wiped the corner 202, the rotatable shaft 102 may temporarily rotate the wipers 104 to the home position of FIG. 1D so that the fluid-ejection printhead 110 may be suitably positioned for the other corner to be cleaned.

Rotational Control of Rotary Wiper Assembly Wipers

Various positions to which the wipers 104 of the rotary wiper assembly 100 can be rotated have been described, including a wiping position in FIG. 1A, a liquid dispensing position in FIG. 1B, a scraping position in FIG. 1C, and a home position in FIG. 1D. To rotate the wipers 104 to any of these positions, the rotatable shaft 102 of the rotary wiper assembly 100 itself rotates, which causes the wipers 104 to correspondingly rotate. As such, rotational control of the rotatable shaft 102 and the wipers 104 is desirable in order to detect how much the shaft 102 and the wipers 104 have rotated and to detect the current position of the wipers 104.

Figure 3:
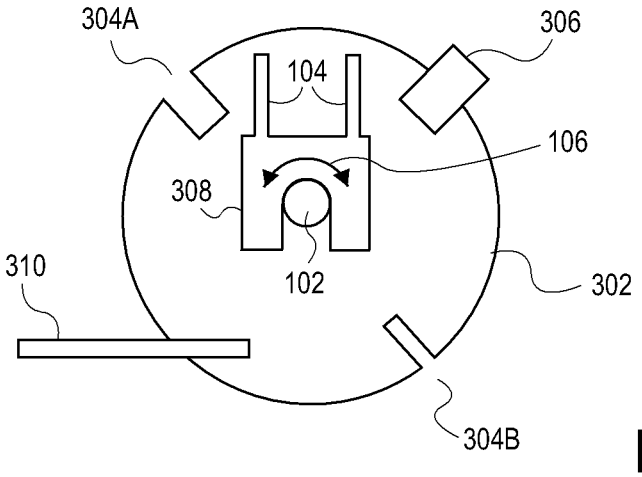
FIG. 3 is a diagram depicting how wipers of a rotary wiper assembly can be rotationally controlled to detect how much the wipers have rotated and the current position of the wipers, according to an embodiment of the present disclosure.

FIG. 3 shows how such rotational control of the rotatable shaft 102 and the wipers 104 of the rotary wiper assembly 100 can be achieved, according to an embodiment of the disclosure. The rotary wiper assembly 100 includes an encoder disc 302 and a sensor 306, which may be an optical sensor. The encoder disc 302 is attached to the rotatable shaft 102 so that rotation of the shaft 102 causes corresponding rotation of the disc 302. The encoder disc 302 has a pattern that is detectable by the sensor 306. For example, in the embodiment of the FIG. 3, the pattern on the encoder disc 302 includes a large notch 304A and a small notch 304B, collectively referred to as the notches 304. The sensor 306 is positioned in relation to the notches 304 so that the sensor 306 is able to detect when each of the notches 304 rotates past the sensor 306.

The rotary wiper assembly 100 has predetermined information as to how much rotation is to occur to rotate the wipers 104 from at least one of the positions of FIGS. 1A, 1B, 1C, and 1D to all the other positions of FIGS. 1A, 1B, 1C, and 1D. Such rotation is thus detected by the sensor 306 detecting the known positions of the notches 304 on the encoder disc 302. For example, rotary wiper assembly 100 may have predetermined information as to how much rotation is to occur to rotate the wipers 104 from the home position of FIG. 1D to each of the wiping position of FIG. 1A the liquid dispensing position of FIG. 1B, and the scraping position of FIG. 1C. As such, the wipers 104 are rotated to the home position of FIG. 1D, and from this home position, can be controllably rotated to any of the other positions of FIGS. 1A, 1B, and 1C.

However, if power is removed from the rotary wiper assembly 100 before the wipers 104 have been returned to the home position of FIG. 1D, for instance, upon re-providing of power the assembly 100 has no way of detecting the current position of the wipers 104. For example, if the wipers 104 are being rotated from the home position of FIG. 1D to the wiping position of FIG. 1A when power is removed, this current position of the wipers 104 is not able to be detected by the rotary wiper assembly 100 when power is again provided to the assembly 100. Therefore, the rotary wiper assembly 100 also includes a rotatable hard stop surface 308 and a fixed hard stop surface 310.

The rotatable hard stop surface 308 rotates with the wipers 104, corresponding to rotation of the rotatable shaft 102, as indicated by the arrow 106. The fixed hard stop surface 310 does not rotate or otherwise move. When power is provided to the rotary wiper assembly 100, if the current position of the wipers 104 is unknown, the rotatable shaft 102 is rotated counter-clockwise until no further rotation is possible, due to the rotatable hard stop surface 308 making contact with the fixed hard stop surface 310 to prevent further such rotation. When the rotatable shaft 102 is so rotated such that the shaft 102 cannot further rotate, the wipers 104 are in an absolute hard stop position.

The rotary wiper assembly 100 has predetermined information as to how much rotation is to occur to rotate the wipers 104 from this absolute hard stop position to at least one of the other positions of FIGS. 1A, 1B, 1C, and 1D of the wipers 104. For example, the rotary wiper assembly 100 may have predetermined information as to how much rotation is to occur to rotate the wipers 104 from its absolute hard stop position to its home position of FIG. 1D. When power is provided to the rotary wiper assembly 100 and the current position of the wipers 104 is unknown, the rotatable shaft 102 is rotated until the wipers 104 are located at its absolute hard stop position. After having so located the absolute hard stop position, the rotatable shaft 102 can be rotated to rotate the wipers 104 to one of the other positions of FIGS. 1A, 1B, 1C, and 1D of the wipers 104.

Detailed Specific Embodiment of Rotary Wiper Assembly

Figure 4:
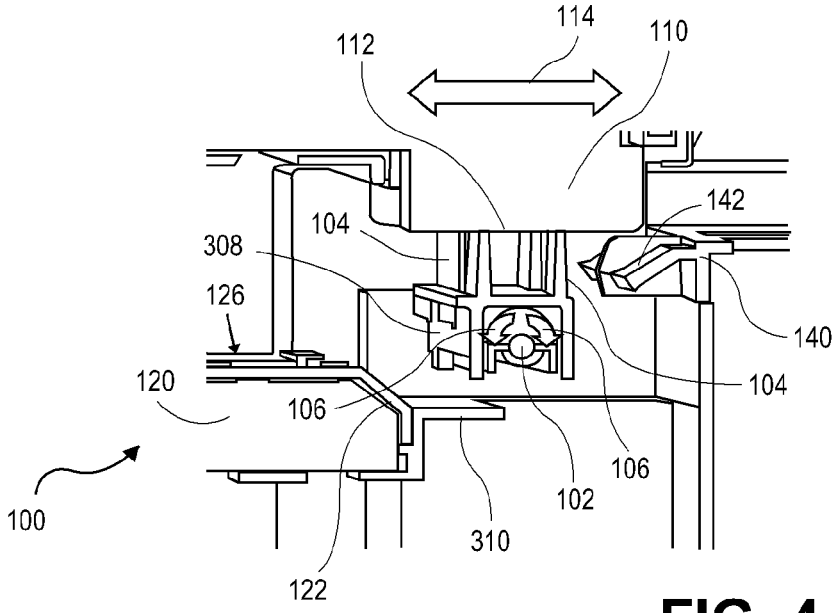
FIG. 4 is a diagram of a portion of a rotary wiper assembly in detail according to an embodiment of the present disclosure.

In this section of the detailed description, a detailed specific embodiment of the rotary wiper assembly 100 is presented. FIG. 4 shows a portion of the rotary wiper assembly 100 in detail, according to an embodiment of the disclosure. In particular, the rotatable shaft 102, the wipers 104, the wiping liquid dispense mechanism 120, the scrape mechanism 140, and the hard stop surfaces 308 and 310 are depicted in relation to one another in FIG. 4. The slot 126 and the downward-sloped surface 122 of the wiping liquid dispense mechanism 120, and the downward-sloped surface 142 of the scrape mechanism 140, are shown in FIG. 4 as well.

As noted above, the rotatable shaft 102 rotates, as indicated by the arrows 106, to move the wipers 104 among the positions of FIGS. 1A, 1B, 1C, and 1D. In FIG. 4 specifically, the wipers 104 are in their stationary wiping position. As such, the fluid-ejection nozzles 112 of the fluid-ejection printhead 110 are wiped by the wipers 104 while the wipers 104 remain stationary in the stationary wiping position, and as the printhead 110 moves linearly as denoted by the arrows 114. The rotatable shaft 102 can further rotate the wipers 104 clockwise to the scraping position in relation to the scrape mechanism 140, or counterclockwise to the home position, to the wiping liquid dispensing position in relation to the wiping liquid dispense mechanism 120, or to the absolute hard stop position.

Figure 5A:
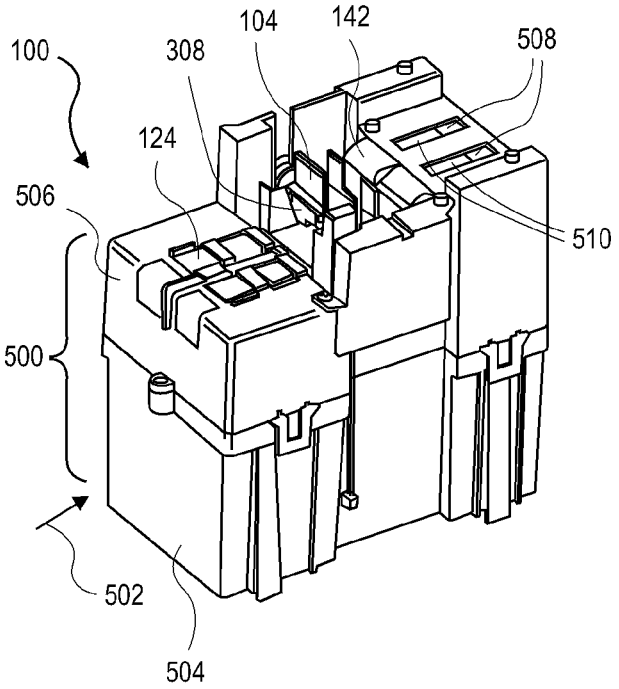
FIGS. 5A and 5B are diagrams of a housing assembly of a rotary wiper assembly, according to an embodiment of the present disclosure.
Figure 5B:
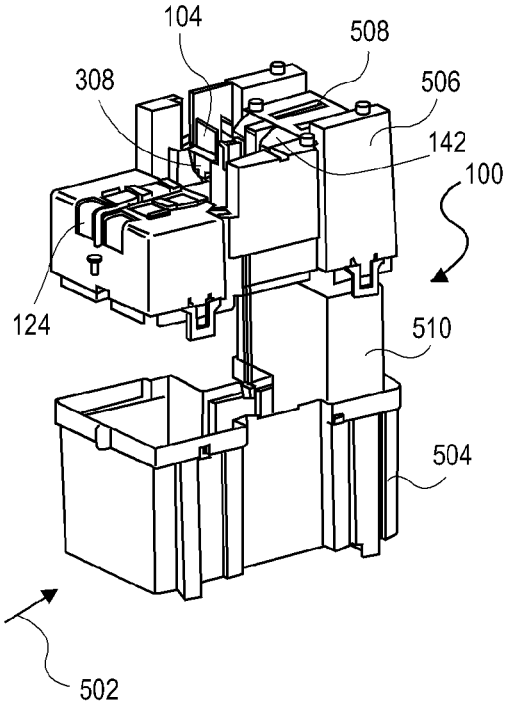

FIGS. 5A and 5B depict a housing assembly 500 of the rotary wiper assembly 100 in detail, according to an embodiment of the disclosure. The arrows 502 in FIGS. 5A and 5B denote a relative perspective of these figures, and are also included in subsequent figures so that their relative perspective can be discerned in relation to FIGS. 5A and 5B. The housing assembly 500 includes a lower housing assembly portion 504 and an upper housing assembly portion 506. In FIG. 5A, the lower and upper housing assembly portions 504 and 506 are shown interlocked together, whereas in FIG. 5B, the lower and upper portions 504 and 506 are shown apart from one another.

The wipers 104 are depicted in FIGS. 5A and 5B, as is the absorbent material 124 of the wiping liquid dispense mechanism 120 of FIGS. 1B and 4. FIGS. 5A and 5B also show the downward-sloped surface 142 of the scrape mechanism 140 of FIGS. 1C and 4. Furthermore, the rotatable hard stop surface 308 is shown in FIGS. 5A and 5B. FIGS. 5A and 5B also depict absorbent material 510 disposed in the lower housing assembly portion 504, which is exposed through slots 508 within the upper housing assembly portion 506.

The absorbent material 510 absorbs undesirable material, such as fluid and media debris, which is ejected by the fluid-ejection printhead 110 of FIGS. 1A and 4 during a spitting operation. The spitting operation may be performed before or after the wiping operation of FIG. 1A, for instance. The spitting operation, in conjunction with the wiping operation, is intended to clear the fluid-ejection nozzles 112 of FIGS. 1A and 4 so that they can properly eject fluid as desired during fluid ejection onto media, for instance.

Figure 6A:
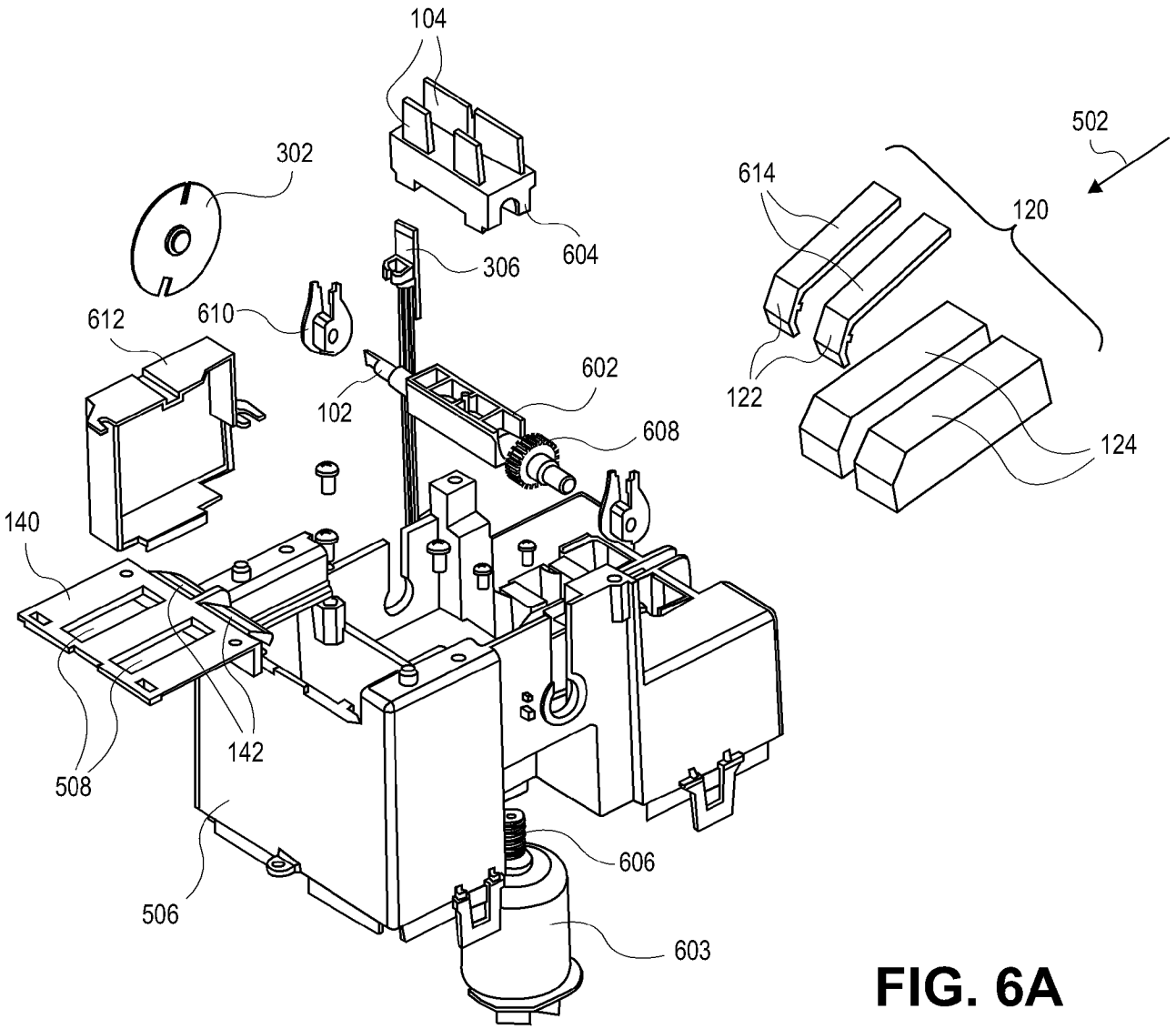
FIGS. 6A and 6B are exploding diagrams of a housing assembly of a rotary wiper assembly in detail, according to an embodiment of the disclosure.

FIG. 6A depicts an exploded view of the upper housing assembly portion 506 in detail, according to an embodiment of the disclosure. The arrow 502 depicts the relative perspective of FIG. 6A, in comparison to the relative perspective of FIGS. 5A and 5B including the same arrow 502. The wipers 104 integrally extend from a wiper boot 604, in that the wipers 104 are formed from the same material as the wiper boot 604, and/or are manufactured as an integral part of the wiper boot 604. In FIG. 6A, there are four wipers 104, including two small wipers and two larger wipers.

The purpose of having two different sizes of wipers in one embodiment is as follows. The small wipers concentrate the wiping force on the fluid-ejection nozzles 112 themselves. By comparison, the large wipers clean any streak of material that may have formed on the underside of the fluid-ejection printhead 110. A wiping operation is desirably completed via a pass by the large wipers, after a pass by the small wipers, to prevent streaking and to wipe any buildup that is wiped onto the underside of the fluid-ejection printhead 110 by the small wipers.

A wiper boot support structure 602 is directly attached to the rotatable shaft 102. The wiper boot 604 is then directly attached to the wiper boot support structure 602. In this way, the wipers 104 are said to be indirectly attached to the shaft 102 in the embodiment of FIG. 6A. This is because the wipers 104 are part of the wiper boot 604, which attaches directly to the wiper boot support structure 602, which attaches directly to the rotatable shaft 102. The wiping liquid dispense mechanism 120 in FIG. 6A includes members 614 having the downward-sloped surfaces 122, as well as the absorbent material 124 that has been described. FIG. 6A further depicts the scrape mechanism 140 having the downward-sloped surfaces 142, and that also includes the slots 508 that expose the absorbent material 510 for spitting purposes (not shown in FIG. 6A).

A motor 603 includes what is referred to as a worm 606 that mates with a helical gear 608 attached to the rotatable shaft 102. The motor 603, the worm 606, and the helical gear 608 together make up a worm drive to rotate the rotatable shaft 102. The encoder disc 302 and the sensor 306 are also depicted in FIG. 6A. The sensor 306 fits within a cam 610 that is attached to the rotatable shaft 102 inward of the end of the shaft 102 at which the encoder disc 302 is attached. A cover 612 covers the encoder disc 302, the cam 610, and the sensor 306.

Figure 6B:
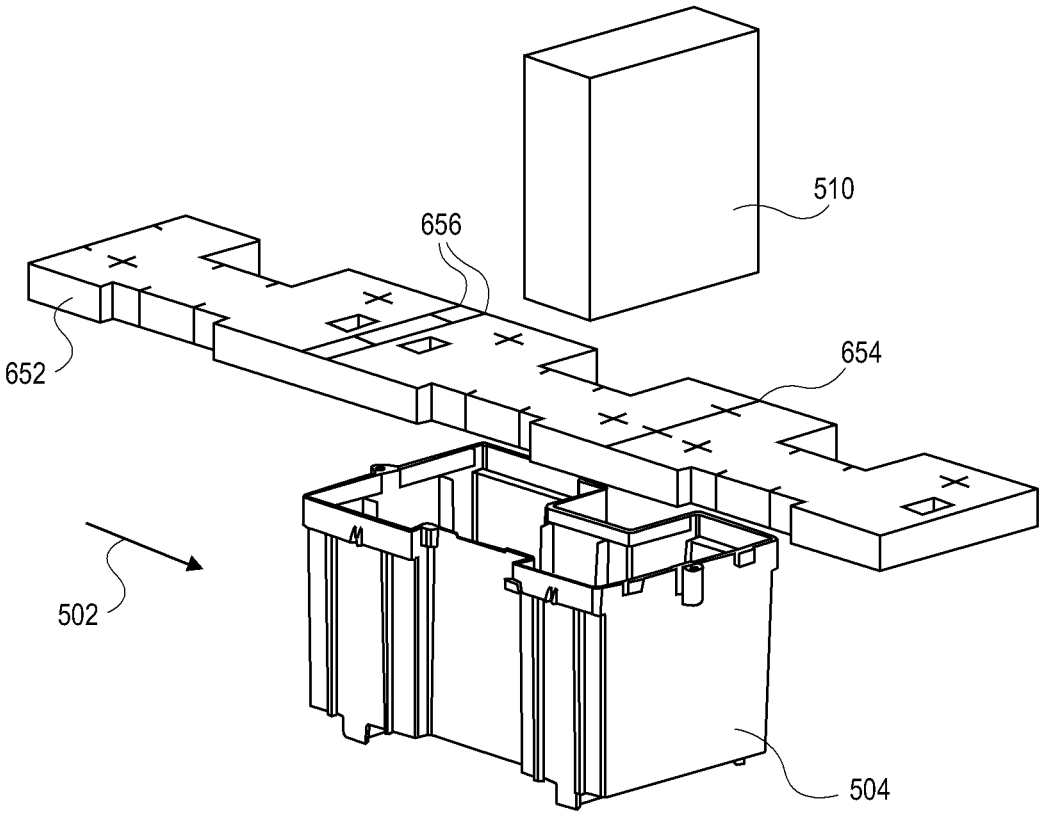

FIG. 6B depicts an exploded view of the lower housing assembly portion 504 in detail, according to an embodiment of the disclosure. The arrow 502 depicts the relative perspective of FIG. 6B, in comparison with the relative perspectives of FIGS. 5A, 5B, and 6A including the same arrow 502. An absorbent material 652 is depicted in FIG. 6B in an unfolded state, and is folded first along the crease 654 and then along the creases 656 before being disposed within the bottom of the lower housing assembly portion 504. The absorbent material 510 is also disposed within the lower housing assembly portion 504.

The absorbent material 510 can capture aerosol or fluid spray mist that results from performing a spitting operation of the fluid-ejection printhead 110 of FIGS. 1 and 4. Similarly, the absorbent material 512 can absorb waste fluid that results from performing a spitting operation of the fluid-ejection printhead 110. The absorbent material 510 may be an aerosol or reticulated foam, whereas the absorbent material 652 may be an absorber pad, such as a foam. The presence of both the absorbent materials 510 and 652 permits greater absorbing capacity of ejected undesirable by the fluid-ejection printhead 110 during spitting, as compared to if just the absorbent material 510 or the absorbent material 652 were present.

Furthermore, the absorbent materials 510 and/or 652 absorb undesired material scraped from the wipers 104 by the downward-sloped surfaces 142 of the scrape mechanism 140, as has been described in relation to FIG. 1C. The downward-sloped surfaces 142 are thus positioned in relation to the absorbent materials 510 and/or 652 to cause the undesired material scraped from the wipers 104 to drain to the absorbent materials 510 and/or 652. Therefore, the absorbent materials 510 and/or 652 contain undesired material removed during spitting of the fluid-ejection printhead 110 as well as undesired material removed during scraping of the wipers 104.

Representative Fluid-Ejection Device

Figure 7:
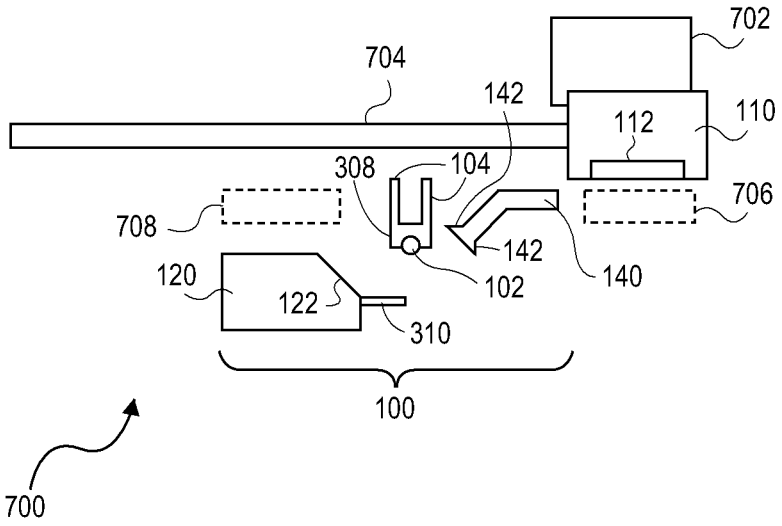
FIG. 7 is a diagram of a representative fluid-ejection device including a rotary wiper assembly, according to an embodiment of the present disclosure.

FIG. 7 shows a representative fluid-ejection device 700 in relation to which the rotary wiper assembly 100 can be included, according to an embodiment of the disclosure. Other types of fluid-ejection devices, besides the fluid-ejection device 700 of FIG. 7, can also include the rotary wiper assembly 100, however. The purpose of presenting the fluid-ejection device 700 is thus to show one kind of fluid-ejection device that can utilize the rotary wiper assembly 100 that has been described.

The fluid-ejection device 700 may be an inkjet-printing device, which is a device, such as a printer, that ejects ink onto media, such as paper, to form images, which can include text, on the media. The fluid-ejection device 700 is more generally a fluid-ejection precision-dispensing device that precisely dispenses fluid, such as ink. The fluid-ejection device 700 may eject pigment-based ink, dye-based ink, another type of ink, or another type of fluid. Embodiments of the present disclosure can thus pertain to any type of fluid-ejection precision-dispensing device that dispenses a substantially liquid fluid.

A fluid-ejection precision-dispensing device is therefore a drop-on-demand device in which printing, or dispensing, of the substantially liquid fluid in question is achieved by precisely printing or dispensing in accurately specified locations, with or without making a particular image on that which is being printed or dispensed on. As such, a fluid-ejection precision-dispensing device is in comparison to a continuous precision-dispensing device, in which a substantially liquid fluid is continuously dispensed therefrom. An example of a continuous precision-dispensing device is a continuous inkjet-printing device.

The fluid-ejection precision-dispensing device precisely prints or dispenses a substantially liquid fluid in that the latter is not substantially or primarily composed of gases such as air. Examples of such substantially liquid fluids include inks in the case of inkjet-printing devices. Other examples of substantially liquid fluids include drugs, cellular products, organisms, fuel, and so on, which are not substantially or primarily composed of gases such as air and other types of gases, as can be appreciated by those of ordinary skill within the art.

Several components of the rotary wiper assembly 100 included in the fluid-ejection device 700 are depicted in FIG. 7. Particularly, the rotatable shaft 102 and the wipers 104 are shown in FIG. 7. Likewise, FIG. 7 shows the wiping liquid dispense mechanism 120, including its downward-sloped surface 122, as well as the scrape mechanism 140, including its downward-sloped surface 142. The hard stop surfaces 308 and 310 are also depicted in FIG. 7, where the fixed hard stop surface 310 is specifically depicted as extending from the wiping liquid dispense mechanism 120.

FIG. 7 further shows the fluid-ejection printhead 110 with its fluid-ejection nozzles 112. The fluid-ejection printhead 110 is attached to a carriage 702, as well as to a rod 704. Two fluid-ejection zones 706 and 708 are defined in FIG. 7. In each of the fluid-ejection zones 706 and 708, the fluid-ejection printhead 110 can eject fluid, like ink, onto media, such as paper or labels. In the fluid-ejection zone 706, the carriage 702 moves the fluid-ejection printhead 110 into and out of the plane of FIG. 7, to eject fluid onto an entire swath of a sheet of media, like a sheet of paper, positioned within the zone 706, as the sheet of media is advanced within the zone 706. By comparison, the fluid-ejection printhead 110 may move along the rod 704 so that the printhead 110 is positioned over the fluid-ejection zone 708, to eject fluid onto media, such as labels, positioned within the zone 708.

The difference between the fluid-ejection zones 706 and 708 of FIG. 7 is that in fluid-ejection zone 706, the fluid-ejection printhead 110 may be able to move via the carriage 702 into and out of the plane of FIG. 7, over an entire swath of media in the zone 706. By comparison, in the fluid-ejection zone 708, the fluid-ejection printhead may not be able to move into and out of the plane of FIG. 7 over an entire swath of media in the fluid-ejection zone 708. As such, the fluid-ejection zone 708 may be useful for ejecting fluid onto labels individually placed within the zone 708, whereas the fluid-ejection zone 706 may be useful for ejecting fluid onto media, like entire sheets of paper.

When the fluid-ejection printhead 110 is ready to eject fluid onto media within the fluid-ejection zone 706 or 708, the wipers 104 may be rotated to their home position of FIG. 1D. The fluid-ejection printhead 110 also can move along the rod 704 so that the printhead 110 is positioned over the rotary wiper assembly 100 for wiping the fluid-ejection nozzles 112 of the printhead 110. In this case, the wipers 104 are rotated to their static wiping position of FIG. 1A, and then the fluid-ejection printhead 110 is linearly moved back and forth along the rod 704 so that the wipers 104 can wipe the fluid-ejection nozzles 112 of the printhead 104.

Concluding Method of Operation of Rotary Wiper Assembly

Figure 8:
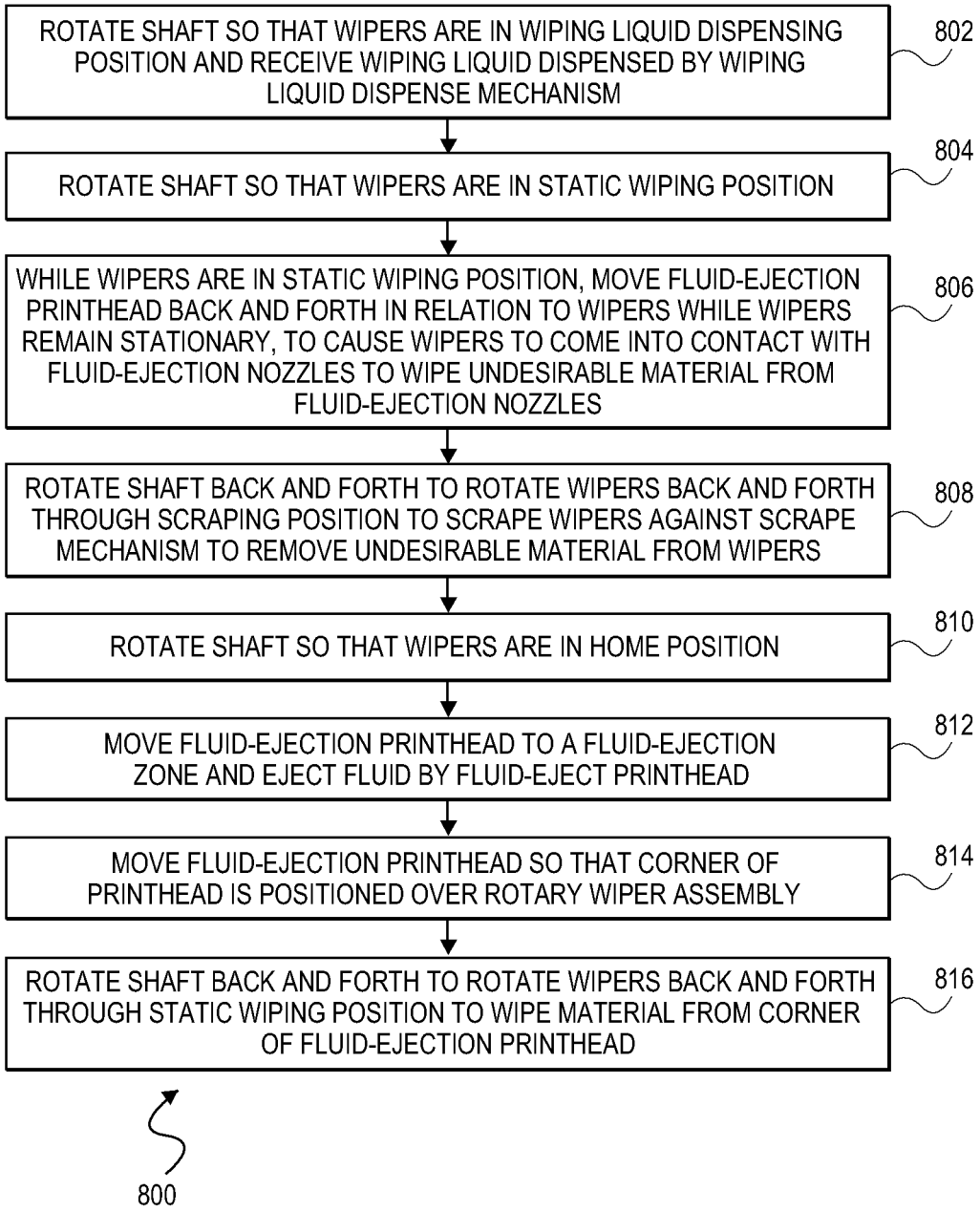
FIG. 8 is a flowchart of a method, according to an embodiment of the present disclosure.

In conclusion, FIG. 8 shows a method 800 depicting representative operation of the fluid-ejection device 700, including the rotary wiper assembly 100 and the fluid-ejection printhead 110 thereof, according to an embodiment of the disclosure. The method 800 presumes that wipers 104 of the rotary wiper assembly 100 are initially clean, and that the fluid-ejection nozzles 112 of the fluid-ejection printhead 110 are to be wiped prior to ejecting fluid onto media. The method 800 concludes with corner cleaning of the fluid-ejection printhead 110, although such corner cleaning may be performed prior to the printhead 110 ejecting fluid onto the media as well.

The rotatable shaft 102 of the rotary wiper assembly 100 is rotated so that the wipers 104 are in the wiping liquid dispensing position of FIG. 1B (802), so that the wipers 104 receive wiping liquid from the wiping liquid dispense mechanism 120. Thereafter, the rotatable shaft 102 is rotated so that the wipers 104 are in the static wiping position of FIG. 1A (804). While the wipers 104 remain in the static wiping position, the fluid-ejection printhead 110 is linearly moved back and forth in relation to the wipers 104, while the wipers 104 remain stationary and do not move, to cause the wipers 104 to come into contact with the fluid-ejection nozzles 112 of the printhead 110 to wipe undesirable material from the nozzles 112 onto the wipers 104 (806). The rotatable shaft 102 is then rotated to rotate the wipers 104 back and forth through the scrape position of FIG. 1C to scrape the wipers 104 against the scrape mechanism 140 to remove the undesirable material from the wipers 104 (808).

Thereafter, the rotatable shaft 102 can be rotated so that the wipers 104 are in the home position of FIG. 1D (810), and the fluid-ejection printhead 110 moved to one of the fluid-ejection zones 706 and 708 to eject fluid onto media (812). For corner cleaning of the fluid-ejection printhead 110, the printhead 110 is first moved so that one of its corners is positioned over the rotary wiper assembly 100 (814). The rotatable shaft 102 is then rotated back and forth to rotate the wipers back and forth through the wiping position of FIG. 1A to wipe material from the corner of the fluid-ejection printhead 110 (816). Parts 814 and 816 of the method 800 may be repeated for the other corner of the fluid-ejection printhead 110.

We claim:

1. A rotary wiper assembly for a fluid-ejection printhead having a plurality of fluid-ejection nozzles, comprising:

one or more wipers:

a wiping liquid dispensing mechanism comprising:

a housing having a top horizontal surface, a downward-sloped surface meeting the top horizontal surface at an edge, a cavity, and a slot at the top horizontal surface;

an absorbent material disposed within the cavity of the housing and within which a wiping liquid is contained, the absorbent material making fluidic contact with the downward-sloped surface via the slot of the housing such that the wiping liquid travels from the absorbent material to the top horizontal surface and then down the downward-sloped surface via gravity; and a rotatable shaft to which the wipers are at least indirectly attached, the rotatable shaft to rotate the wipers between a static wiping position and a wiping liquid dispensing position, wherein while the wipers are rotated back and forth within the wiping liquid dispensing position, the wipers making contact with the downward-sloped surface to receive the wiping liquid on the downward-sloped surface by interference and capillary action, and wherein while the wipers are stationary in the static wiping position, the fluid-election printhead is to move back and forth in relation to the wipers while the wipers are not to move to cause the wipers to come into contact with the fluid-ejection nozzles to wipe material from the fluid-election nozzles.

2. The rotary wiper assembly of claim 1, further comprising:

a scrape mechanism to scrape material from the wipers, wherein the rotatable shaft is further to rotate the wipers back and forth through a scraping position so that the wipers are to be scraped by the scrape mechanism.

3. The rotary wiper assembly of claim 2, wherein the scrape mechanism comprises:

a downward-sloped surface with which the wipers are to make contact for the downward-sloped surface to scrape the wipers, wherein the downward-sloped surface is to cause the material scraped from the wipers to drain away from the wipers.

4. The rotary wiper assembly of claim 1, wherein in a home position, the wipers are not in a position to contact the fluid-ejection nozzles while the fluid-ejection printhead is to eject fluid onto media.

5. The rotary wiper assembly of claim 1, wherein the rotatable shaft is further to rotate the wipers back and forth while a corner of the fluid-ejection printhead is suitably positioned so that the wipers are to wipe material from the cornet of the fluid-ejection printhead.

6. The rotary wiper assembly of claim 1, further comprising:

an encoder disc attached to the rotatable shaft;

a sensor to detect rotation of the encoder disc to determine one or more of a direction of rotation of the rotatable shaft while the rotatable shaft is to rotate and a degree of rotation of the rotatable shaft while the rotatable shaft is to rotate;

a rotatable hard stop surface to rotate with rotation of the rotatable shaft; and, a fixed hard stop surface with which the rotatable had stop surface is to come into contact to prevent further rotation of the rotatable shaft and to locate an absolute hard stop position of the wipers.

7. The rotary wiper assembly of claim 1, further comprising:

a wiper boot from which the wipers integrally extend; and, a wiper boot support structure directly attached to the shaft and to which the wiper boot is directly attached, such that the wipers are attached to the shaft via wiper hoot being directly attached to the wiper boot support structure that is directly attached to the shaft.

8. The rotary wiper assembly of claim 1, further comprising:

a housing assembly having a lower housing assembly portion and an upper housing assembly portion;

a first absorbent material disposed in the upper housing assembly portion and exposed through one or more first slots within the upper housing assembly portion;

a first downward-sloped surface extending from the upper housing assembly portion, in fluidic contact with the first absorbent material via the first slots, and against which the wipers are to make contact in a wiping liquid dispensing position to receive the wiping liquid via interference and capillary action;

one or more second absorbent materials disposed in the lower housing assembly portion and exposed through one or more second slots within the upper housing assembly portion to absorb material ejected by the fluid-ejection printhead during a spitting operation; and, a second downward-sloped surface with which the wipers are to make contact for the second downward-sloped surface to scrape the wipers while the wipers are to be moved back and forth through a scraping position, the second downward-sloped surface positioned in relation to the second absorbent materials to cause material scraped from the wipers to drain to the second absorbent materials.

9. A fluid-ejection device comprising:

a fluid-ejection printhead having a plurality of fluid-ejection nozzles through which fluid is ejected; and a rotary wiper assembly comprising:

one or more wipers;

a wiping liquid dispensing mechanism comprising:

a housing having a top horizontal surface, a downward-sloped surface meeting the top horizontal surface at an edge, a cavity, and a slot at the top horizontal surface;

an absorbent material disposed within the cavity of the housing and within which a wiping liquid is contained, the absorbent material making fluidic contact with the downward-sloped surface via the slot of the housing such that the wiping liquid travels from the absorbent material to the top horizontal surface and then down the downward-sloped surface via gravity; and a rotatable shaft to which the wipers are at least indirectly attached, the rotatable shaft to rotate the wipers between a static wiping position and a wiping liquid dispensing position, wherein while the wipers are rotated back and forth within the wiping liquid dispensing position, the wipers making contact with the downward-sloped surface to receive the wiping liquid on the downward-sloped surface by interference and capillary action, and wherein while the wipers are stationary in the static wiping position, the fluid-ejection printhead is to move back and forth in relation to the wipers while the wipers are not to move to cause the wipers to come into contact with the fluid-ejection nozzles to wipe material from the fluid-ejection nozzles.

10. The fluid-ejection device of claim 9, wherein the rotary wiper assembly further comprises:

a scrape mechanism to scrape material from the wipers, wherein the rotatable shaft is further to rotate the wipers back and forth through a scraping position so that the wipers are to be scraped by the scrape mechanism, wherein the scrape mechanism comprises a downward-sloped surface with which the wipers are to make contact for the downward-sloped surface to scrape the wipers, and wherein the downward-sloped surface is to cause the material scraped from the wipers to drain away from the wipers.

11. A method comprising:

dispensing a wiping liquid from an absorbent material disposed within a cavity of a housing of a wiping liquid dispensing mechanism through a slot at a top horizontal surface of the housing, such that the wiping liquid travels from the absorbent material to the top horizontal surface and then down a downward-sloped surface of the housing that meets the top horizontal surface at an edge via gravity, the absorbent material making fluidic contact with the downward-sloped surface via the slot;

rotating a rotatable shaft of a rotary wiper assembly having one or more wipers so that the wipers rotate back and forth within a wiping liquid dispensing position such that the wipers make contact with the downward-sloped surface to receive the wiping liquid on the downward sloped surface by interference and capillary action;

rotating the rotatable shaft so that the wipers are in a static wiping position; and while the wipers are stationary in the static wiping position, moving a fluid-ejection printhead back and forth in relation to the wipers while the wipers are Rot to move to cause the wipers to come into contact with the fluid-ejection nozzles to wipe material from the fluid-ejection nozzles.

12. The method of claim 11, further comprising one or more of:

rotating the rotatable shaft of the rotary wiper assembly such that the wipers are in a home position in which the wipers cannot contact the fluid-ejection nozzles while the fluid-ejection printhead ejects fluid onto media;

rotating the rotatable shaft of the rotary wiper assembly such that the wipers are in a wiping liquid dispensing position in which the wipers are to receive wiping liquid dispensed by a wiping liquid dispense mechanism via interference and capillary action;

rotating the rotatable shaft of the rotary wiper assembly back and forth such that the wipers rotate back and forth through a scraping position to scrape the wipers against a scrape mechanism to scrape material from the wipers; and, rotating the rotatable shaft of the rotary wiper assembly back and forth such that the wipers rotate back and forth while a corner of the fluid-ejection printhead is suitably positioned so that the wipers wipe material from the corner of the fluid-ejection printhead.

* * * * *